United States Patent [19]

Schaller et al.

[11] Patent Number: 4,783,725

[45] Date of Patent: Nov. 8, 1988

[54] FLASHLIGHT WITH SPACE EFFICIENT REFLECTOR

[75] Inventors: David R. Schaller, Janesville; El-Sayed Megahed, Madison, both of Wis.; Charles F. Samson, Walpole, Mass.

[73] Assignee: Rayovac, Madison, Wis.

[21] Appl. No.: 88,679

[22] Filed: Aug. 24, 1987

[51] Int. Cl.[4] ..... F21I 15/06

[52] U.S. Cl. ..... 362/157; 362/247

[58] Field of Search ..... 362/157, 247, 347, 350, 362/200, 349, 34

[56] References Cited

U.S. PATENT DOCUMENTS

| | | | |
|---|---|---|---|
| 1,211,750 | 1/1917 | Paul | 362/349 |
| 1,225,032 | 5/1917 | Hotchkin | 362/350 |
| 1,226,325 | 5/1917 | Geromanos | 362/247 |
| 1,445,306 | 2/1923 | Epstein | 362/347 |
| 1,562,186 | 11/1925 | Pouell et al. | 362/247 |
| 1,574,543 | 2/1926 | Andersen | 362/247 |
| 1,730,571 | 10/1929 | Hamilton | 362/347 |
| 1,930,206 | 10/1933 | Luebbe | 362/247 |
| 1,948,680 | 2/1934 | Rose | 362/350 |
| 2,261,000 | 10/1941 | Muldoon | 362/157 |
| 2,866,083 | 12/1958 | Lima, Jr. | 362/200 |
| 3,758,773 | 9/1973 | Nau | 362/157 |
| 4,517,631 | 5/1985 | Mullins | 362/34 |

*Primary Examiner*—Raymond A. Nelli

*Attorney, Agent, or Firm*—Kenyon & Kenyon

[57] ABSTRACT

A space-saving flashlight is described which has a special reflector. The reflector is elongated and sectioned along a longitudinal plane to take advantage of the non-spherical light distribution of typical light sources. The reflector may be axially spaced from, or folded over the flashlight housing section holding the flashlight power source.

23 Claims, 3 Drawing Sheets

FLASHLIGHT WITH SPACE EFFICIENT REFLECTOR

BACKGROUND OF THE INVENTION

A. Field of the Invention

This invention pertains to a flashlight with a built-in reflector configured to reduce the volume and dimensions of the flashlight and more particularly to a flashlight with a reflector having the shape of a geometric solid cut along a plane parallel to a longitudinal axis thereof.

B. Description of the Prior Art

Traditional flashlights are normally provided with a reflector having rotational symmetry. In other words, the reflector had the shape of a section of sphere, paraboloid or other similar curved surfaces formed by rotating a generatrix around a longitudinal axis passing through the bulb of the flashlight. A major problem with this type of reflectors has been that they had to be extensive to capture and redirect substantially all the light generated by the bulb. Because of their circular symmetry, the reflectors were very bulky, occupying a large portion of the volume of the flashlight. Other types of reflectors have been generally known in various related arts, but none of these known shapes are applicable to flashlights. Some references disclosing various devices with reflectors are summarized below.

U.S. Pat. No. 1,445,306 discloses a headlamp with a semiparaboloid or semielipsoid reflector surface of revolution and plane reflective surface forming a hood.

U.S. Pat. No. 1,225,032 discloses a reflector which may be used either for a headlight or a stationary ceiling light having two hemispherical surfaces with perpendicular axes.

U.S. Pat. No. 4,517,631 discloses a convoluted reflector for dispersing the light from a tubular light source such as a fluorescent lamp.

U.S. Pat. Nos. 1,211,750, 1,730,571 and 1,948,680 disclose other convoluted or sectioned reflectors. In general, headlights and stationary lamps are required to produce a divergent light beam, as compared to flashlights.

U.S. Pat. No. 2,866,083 discloses a "folded" flashlight with a battery and reflector lying side-by-side rather than end-to-end. However, the reflector is cylindrical and is shaped to project a light beam at a right angle rather than in parallel with the battery. As a result, the beam from the flashlight is very diffused.

U.S. Pat. Nos. 3,758,773 and 2,261,000 disclose flashlights with reflectors having sectional paraboloidal shapes. The reflector and batteries are disposed end-to-end.

SUMMARY OF THE INVENTION

In view of the above problems, it is an objective of the present invention to provide a flashlight with a reflector which is shaped to capture and redirect the light generated by a bulb in a preselected beam, in a space efficient manner.

Another objective of this invention is to provide a flashlight which can be produced efficiently, at a low cost and has components that are easy to manufacture.

Other objectives and advantages of the invention shall become apparent from the following description of the invention. According to the present invention, a flashlight is provided with a reflector which is a section of geometric shape. The geometric shape is symmetrical around a longitudinal axis and is sectioned by a plane in parallel with the axis.

The flashlight has a housing for the batteries which also has a longitudinal axis. Preferably the reflector is attached to the housing in such a manner that the two longitudinal axes are parallel. In an alternate embodiment of the invention, the reflector abuts the housing so that the two axes are coincident. Because the reflector does not extend too far laterally as compared to reflectors in prior flashlight, the overall dimensions of the present flashlight, and more particularly the dimensions normal to its longitudinal axis are reduced.

DETAILED DESCRIPTION OF THE INVENTION

Figure 1:
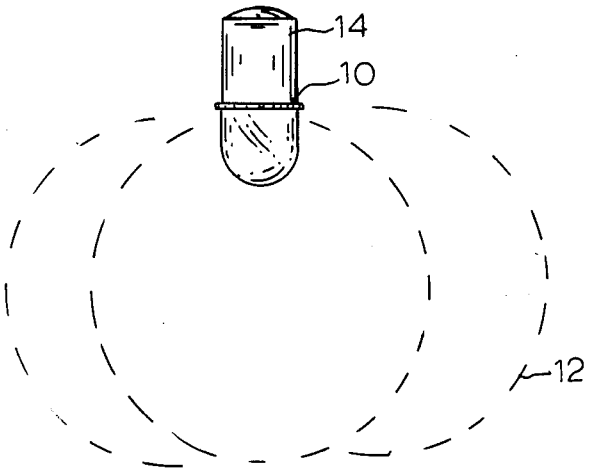
FIG. 1 shows in two dimensions the distribution of light from a typical flashlight bulb.

The present invention takes advantages of the fact that a practical point source of light, such as a typical flashlight lightbulb 10, a light emitting diode, a laser diode or other asymmetrical sources do not distribute light spherically evenly. Instead such sources have at least a polar region in which there is no substantial light output. For example, in FIG. 1, the approximate pattern of light 12 is disposed in front of the lamp, with virtually no light being produced behind the lamp, i.e. the region of space adjacent the bulb base 14. Therefore the lamp may be positioned with the fillament center 16 positioned on the longitudinal axis 18 of a reflector 20. Reflector 20 is formed around the axis 18 in the shape of a paraboloid (or other similar shapes). (In the drawings, the reflectors are shown somewhat elongated for the sake of clarity.) However, as shown in FIG. 3, the reflector does not extend above a horizontal plane passing through axis 18. Because virtually no light is generated in the region above this axis, substantially all the light from the bulb 10 is effectively intercepted by the reflector 20 and reflected in along parallel rays 22 as shown in FIG. 2.

Figure 2:
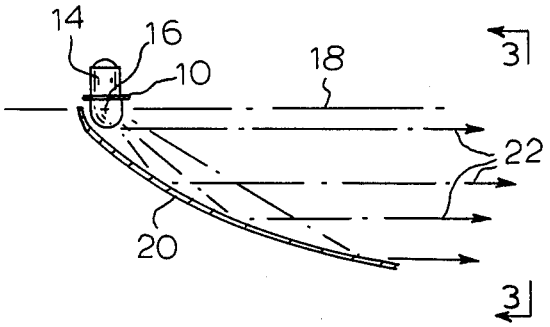
FIG. 2 shows in a side view, the respective position of a light bulb and a reflector constructed in accordance with the invention.
Figure 3:
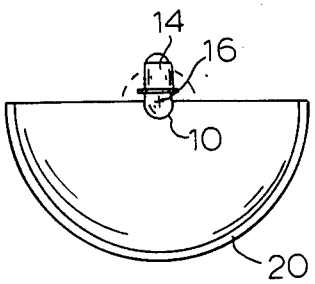
FIG. 3 shows an end view of the configuration of FIG. 2.
Figure 4:
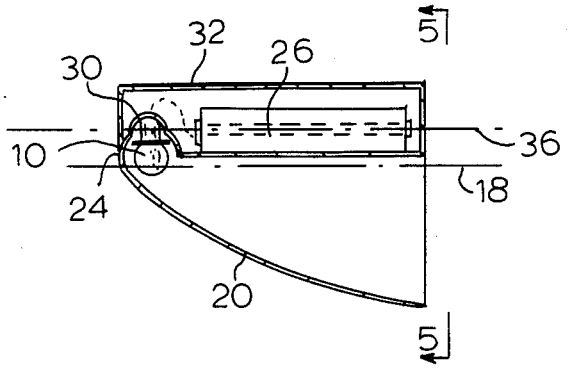
FIG. 4 shows in a side view, a flashlight with the reflector of FIG. 2 formed with a cavity for the bulb.
Figure 5:
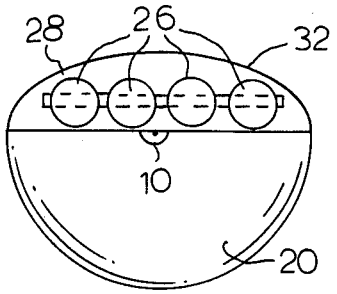
FIG. 5 shows an end view of the flashlight of FIG. 4.

A flashlight incorporating the concepts of FIG. 1–3 is shown in FIGS. 4 and 5. The flashlight includes a housing 24 which includes batteries 26 as well as bulb 10 and reflector 20. The reflector extends upwardly around the bulb as at 30 to form a socket for the bulb. A top section 32 of the housing may be removable to provide access to the batteries. As compared with standard flashlight configurations, the flashlight of FIGS. 4 and 5 has a reflector which is in effect folded over the portion of the housing holding the batteries, so that a longitudinal axis 34 of the housing is in parallel with the longitudinal axis 18 of the reflector. This configuration is smaller then previous configurations because the reflector is half the size of previous reflectors.

Figure 6:
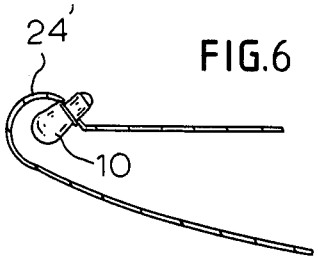
FIGS. 6 and 7 show a second alternate embodiment of the invention.

In FIG. 6 an alternate embodiment is shown. In this embodiment the bulb placed at an angle ranging from 30 to 60 degrees with respect to the reflector axis. In this configuration, the connections to the batteries are easier to establish. Reflector extension 24' is still capable of capturing substantially all the light produced by the bulb and redirect it towards the main reflecting surface of the reflector 24.

Figure 7:
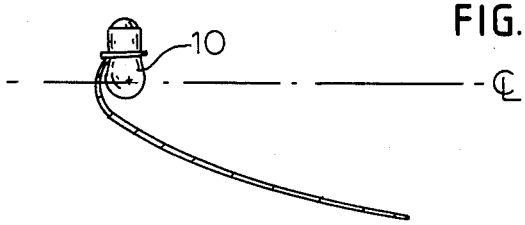

In FIGS. 2, 3, 4 and 5 bulb 10 is positioned so that the filament center corresponds with the focus of the reflector. In the configuration shown in FIG. 7, the bulb 10 is shifted slightly toward the apex of the reflector, and away from the reflector focus point to generate a somewhat divergent light beam. Alternately, FIG. 7 shows a position for the light source intermediate between the positions of FIGS. 2 and 6 with a shorter focal length.

Figure 9:
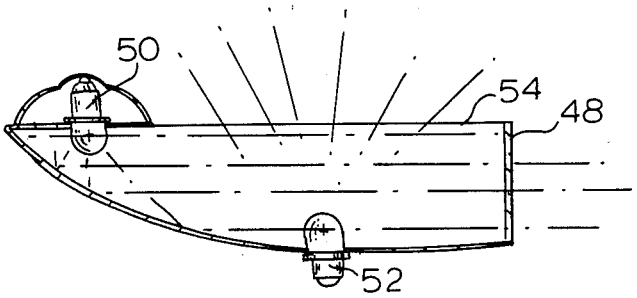
FIG. 9 shows a side sectional view of the embodiment of FIG. 8.
Figure 8:
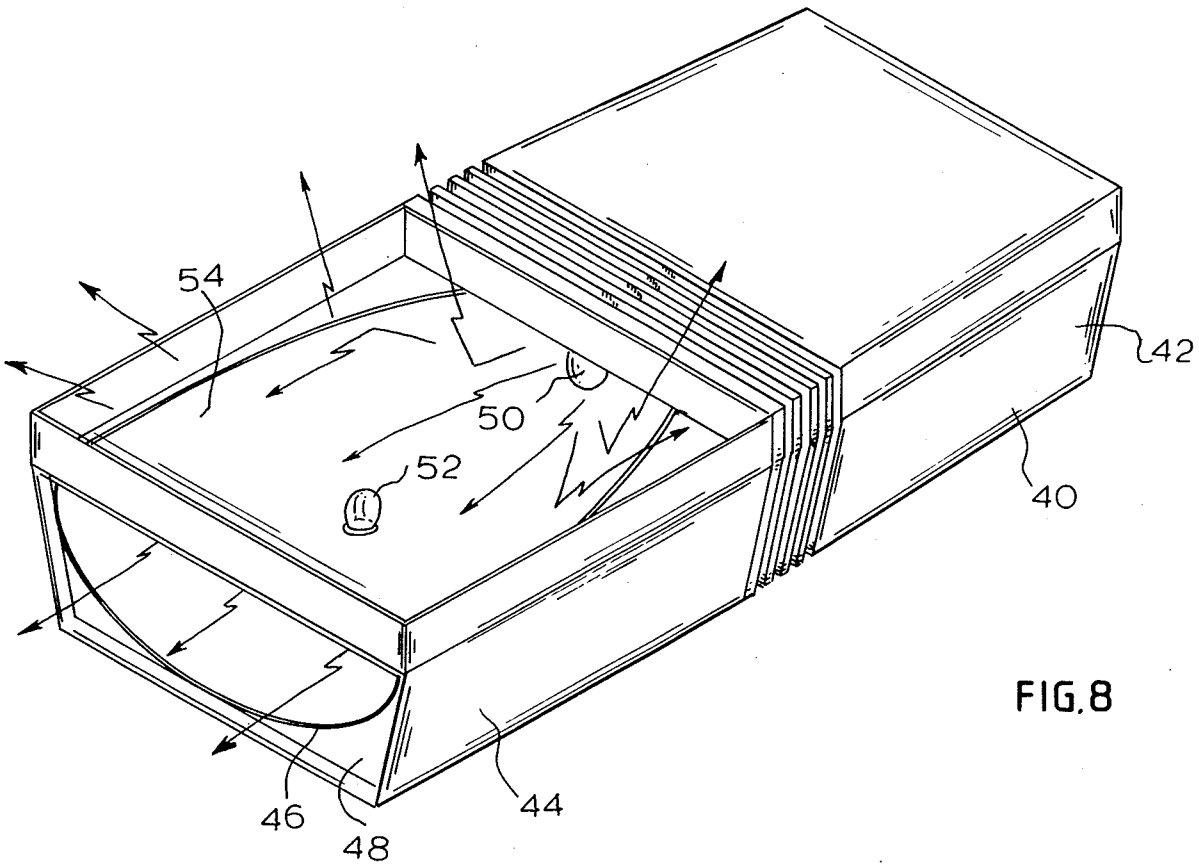
FIG. 8 shows a third embodiment of the invention, in a perspective view.

Another embodiment is shown in FIGS. 8 and 9. In this embodiment, flashlight has a housing 40 with a first portion 42 for holding the batteries and a second portion 44 axially spaced with respect to portion 42 for holding a reflector 46. Reflector 20 has the same general shape as reflector 20 in FIGS. 2–5. Housing portion 44 has a first transparent wall 48. The flashlight also has a first light bulb 50 positioned to generate a colimated light beam through sidewall 46. Advantageously, a second light bulb 52 may be placed adjacent to the reflector wall. In this configuration, light from bulb 52 is reflected in a wide beam. The reflector housing portion 44 has a second transparent wall 54 for transmitting the wide beam generated by bulb 52. The beams generated by the two bulbs are oriented along two axes which are generally perpendicular to each other. Switching means may be used for activating the bulbs simultaneously or alternately.

Figure 10:
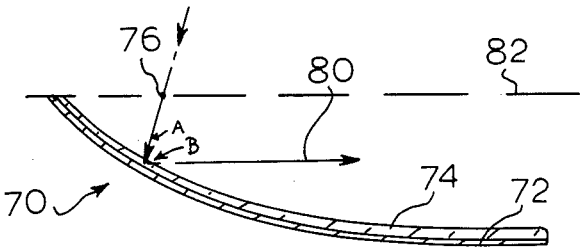
FIG. 10 shows a fourth embodiment of the invention.

In the embodiments of FIGS. 1–9, light from a point source is projected in a predetermined pattern by a reflector. The reflector is made typically from a plastic material which is coated at least one surface with a light-reflecting material such as silver, aluminum or other similar materials. In FIG. 10, a more complex light-beam shaping element 70 is disclosed. This element 70 comprises two sections: a reflecting section 72, and a refracting section 74. The two sections are mated so that preferably there is no air gap between them. The two sections cooperate to generate a beam of preselected shape from a point light source. For example, the two sections may be shaped so that light from a point source incident on an outer surface 78 of section 74 at an angle A and is refracted by the surface so that it propagates at a different angle B before hitting the reflecting surface of section 72. The rays reflected by section 72 are refracted a second time by section 74.

If sections 72, 74 are paraboloid and if source 76 is at the focal point of the paraboloid, then beam 80 is substantially in parallel with a longitudinal axis 82 of the beam-shaping element 70. Thus, section 74 acts as an optical lens. A combination of a lens and a reflecting surface such as shown in FIG. 10 is generally known as a Mangin lens mirror. However, all such previous Margin lens mirrors were formed symmetrically around an axis. The light-shaping element of FIG. 10, in contrast has been sectioned along a longitudinal plane so that it is no longer symmetrical to its longitudinal axis. As shown in FIG. 10, preferably this element is sectioned along a plane which coincides with the longitudinal axis. However, the plane may also be disposed in parallel with the axis so that it is either above or below the axis.

The reflector elements of FIGS. 1–10 may have paraboloid, ellipsoid or other similar geometric shape obtained by rotating a generatrix around a longitudinal axis and then sectioning the shape along a plane substantially parallel to said axis.

As previously described, the light source for the flashlight is a bulb with an incandescent fillament. However, other light sources may be used. For example the light source may compound a light emitting diode (LED).

Obviously, numerous other modifications may be made to the invention without departing from its scope as defined in the appended claims.

We claim:

1. A hand-held flashlight comprising:

(a) light-generating means having a light-generating axis for generating light in a polar pattern substantially in a first direction along said light-generating axis; and (b) a light-shaping means for shaping said light into a light beam, said light-shaping means having a shape formed by rotating a generatrix around a longitudinal axis extending in a second direction to form a three-dimensional solid, and sectioning said solid with a plane substantially parallel to said second direction said light-generating axis being disposed in perpendicular to said longitudinal axis for projecting said polar pattern toward said light-shaping means.

2. The flashlight of claim 1 wherein said plane coincides with said longitudinal axis.

3. The flashlight of claim 1 wherein said plane is parallel to but offset from said longitudinal axis.

4. The flashlight of claim 1 wherein said three dimensional solid is a paraboloid.

5. The flashlight of claim 1 wherein said three dimensional solid is an ellipsoid.

6. The flashlight of claim 1 wherein said three dimensional solid is a hyperboloid.

7. The flashlight of claim 1 wherein said beam is projected by said light shaping means in parallel with said longitudinal axis.

8. A hand-held flashlight comprising:

(a) a housing for holding a power supply, and having a first longitudinal axis;

(b) a light source coupled to said power supply and having an optical axis for generating light in a polar pattern substantially in a preselected direction along said optical axis; and (c) light shaping means for shaping said light into a beam, said light shaping means having a shape formed by rotating a generatrix around a longitudinal axis extending in a second longitudinal axis extending in a preselected direction, to form a three-dimensional solid, and sectioning said solid with a plane substantially parallel with said preselected direction said second longitudinal axis being disposed in perpendicular to said optical axis.

9. The flashlight of claim 8 wherein said light shaping means has a focal point and said light source is disposed at said focal point for generating a collimated light beam.

10. The flashlight of claim 7 wherein said power source comprises at least one battery.

11. The flashlight of claim 10 wherein said battery is oriented along said first longitudinal axis.

12. The flashlight of claim 8 wherein said first and second longitudinal axes are coincident.

13. The flashlight of claim 8 wherein said first and second longitudinal axes are in parallel.

14. A hand-held flashlight comprising:

(a) a housing for holding a power source, and having a first longitudinal axis;

(b) a light source coupled to said power source for generating light in a polar pattern along an optical axis; and (c) light shaping means for shaping said light into a beam, said light shaping means having a shape formed by rotating a generatrix around a second longitudinal axis extending a preselected direction to form a three-dimensional solid, and sectioning said solid with a plane substantially in parallel with said preselected direction, said optical axis being disposed perpendicularly to said second longitudinal axis for projecting said polar pattern toward said light shaping means.

15. The flashlight of claim 14 wherein said plane coincides with said second longitudinal axis.

16. The flashlight of claim 14 wherein said first longitudinal axis coincides with said second longitudinal axis whereby said reflector means is axially aligned with said battery housing.

17. The flashlight of claim 14 wherein said first and second longitudinal axes are in parallel whereby said reflector means is folded over said battery housing.

18. The flashlight of claim 14 wherein said reflector means has a focal point and said light source is disposed near said focal point for generating a substantially collimated light object beam along said second axis.

19. The flashlight of claim 18 further comprising a second point light source cooperating with said reflector means for generating a wide-angle beam.

20. The flashlight of claim 14 wherein said light source comprises a light object bulb with an incandescent filament.

21. The flashlight of claim 14 wherein said light source generates a polar light pattern.

22. The flashlight of claim 21 wherein said light source is selected from the group consisting of an incandescent filament, a light-emitting diode and a solid-state laser diode.

23. The flashlight of claim 14 wherein said reflector means comprises a Mangin lens mirror or other catadioptic form.

* * * * *